United States Patent [19]

Carlson

[11] 4,204,708

[45] May 27, 1980

[54] DOOR LATCH ASSEMBLY

[76] Inventor: Harold W. Carlson, 15833 W. 11 Mile Rd., Apt. 105, Southfield, Mich. 48073

[21] Appl. No.: 961,698

[22] Filed: Nov. 17, 1978

[51] Int. Cl.[2] ..... E05C 3/04

[52] U.S. Cl. ..... 292/292; 292/218

[58] Field of Search ..... 292/290, 297, 298, 213, 292/218, 288, 264, 102, 238, 68, 304

[56] References Cited

U.S. PATENT DOCUMENTS

| | | | |
|---|---|---|---|
| Re. 29,162 | 3/1977 | McLennan | 292/290 |
| 603,477 | 5/1898 | Butts | 292/297 |
| 3,401,969 | 9/1968 | Neel | 292/264 |
| 3,761,118 | 9/1973 | Westcott | 292/162 |
| 3,914,965 | 10/1975 | Poxton | 292/288 |

*Primary Examiner*—Richard E. Moore

*Attorney, Agent, or Firm*—Harness, Dickey & Pierce

[57] ABSTRACT

A door latch assembly comprises a latch plate which fits inside the clearance space between the edge of a door and a door jamb and is secured to the door jamb so that a portion projects into the room into which the door opens and a latch bar member which removably fits in perforations in the plate to provide a removable barrier preventing the door from being opened.

4 Claims, 5 Drawing Figures

DOOR LATCH ASSEMBLY

BRIEF SUMMARY OF THE INVENTION

It is the purpose of this invention to provide a door latch construction that will withstand a large door opening force but which is of relatively simple construction and easy to install.

The invention accomplishes this by means of a door latch assembly comprising a latch plate that is secured to the door jamb and a latch member that removably fits in the latch plate to hold a door in a closed position.

DESCRIPTION OF THE INVENTION

Figure 1:
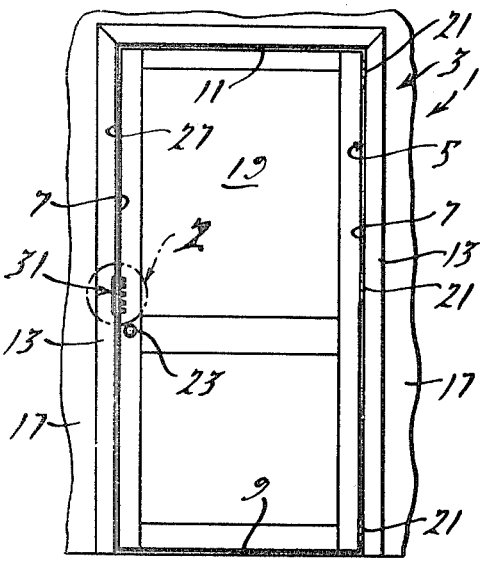
FIG. 1 is a side elevation partly broken away of a door construction having a door latch assembly according to the invention installed therein.
Figure 3:
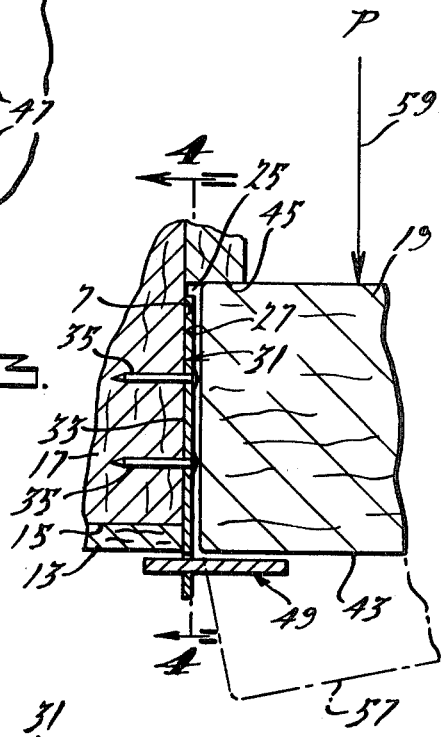
FIG. 3 is a cross section along the line 3—3 of FIG. 2.

A buidling 1 has a wall 3 with a door opening 5 defined by vertical door jamb members 7, a floor surface 9, and a horizontal upper member 11. Molding 13 may be secured on the surface 15 of the wall 17 adjacent the inside corner of the vertical door jamb elements 7 as seen best in FIGS. 1 and 3. A door member 19 is hinged to one of the door jambs 7 by hinge elements 21 so that the door 19 can swing inwardly into a room defined in part by the wall 17. The door is removably attached to the wall 17 by a conventional door handle operated latch mechanism indicated at 23 and any other locking and latching mechanisms that are desired.

Because of the swinging movement of the door 19 on the hinge elements there is some clearance 25 between the door jamb 7 and the opposing side edge 27 of the door 19. In accordance with the present invention this space is used for a door latch assembly 31, and, in particular, for a thin, flat latch plate 33 which fits flush against the surface of the door jamb 7 and is tightly secured to it, as by nails 35 extending through holes 37 formed in the plate. When secured in place by the fasteners 35, the plate 33 has an inner end or lip portion 39 that extends beyond the surface of the molding 13 into the room. The lip 39 has a series of vertically aligned and vertically spaced rectangular openings 41 formed in it. The plate 33 is positioned on the door jamb 7 so that the openings are close to the inside face 43 of the door member 19 when it is in its fully closed position bearing against the vertical shoulder and stop member 45. The openings 41 form latch holes to receive rectangular latch arms 47 on the latch bar member 49.

Figure 2:
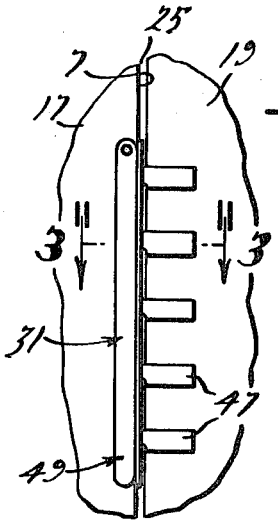
FIG. 2 is an enlarged view of the structure within the circle 1 of FIG. 1.
Figure 4:
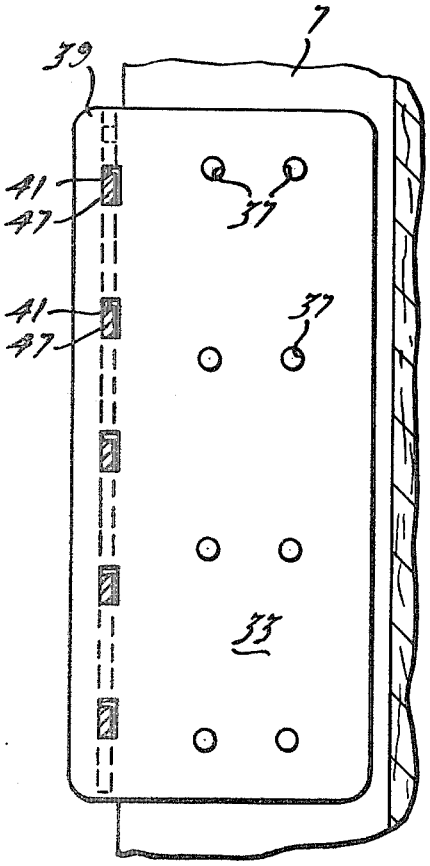
FIG. 4 is a cross section along the line 4—4 of FIG. 3.
Figure 5:
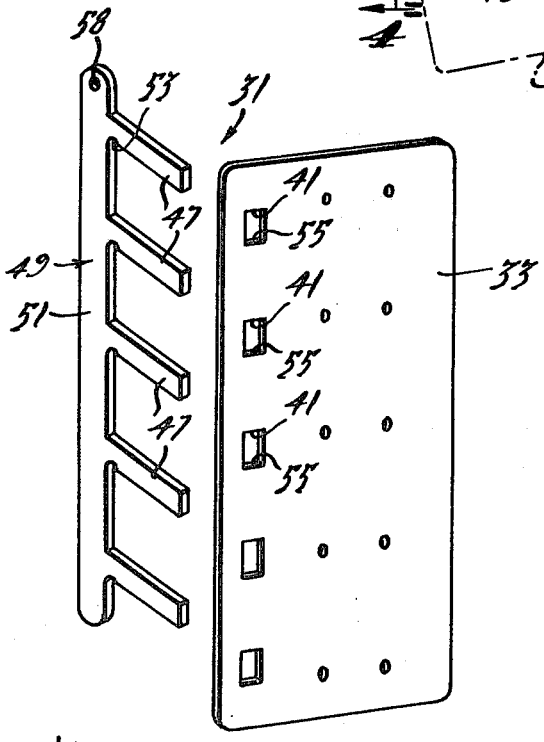
FIG. 5 is an exploded perspective view of the latch assembly.

As seen best in FIGS. 2 and 5, the latch member 49 has a vertical bar section or body 51 interconnecting and integral with the arms 47 which are vertically spaced from one another by amounts corresponding to the spacing of the latch openings 41. The latch arms 47 have cross sections which are preferably smaller than that of the openings 41, as can be seen in FIG. 4. At the corner between the arms 47 and the bar or body 51, notches 53 having a thickness somewhat greater than that of the latch plate 33 are formed in the arms. This enables the latch arms to settle on opposite sides of the bottom edges 55 of the openings 41 so that a slight vertical component of motion is required to lift the latch member 49 before it can be withdrawn by horizontal movement. The latch bar 49 preferably has an opening 58 through it that can be used as a means for securing a wire or other flexible member to it in the event that it is wished to attach the latch member 49 to the wall 17 and/or to the plate 33.

The homeowner who wishes to utilize the present door latch assembly can simply nail the plate 33 in position against the face of the door jamb 7 at the desired vertical height, preferably high enough to be out of the way of small children. When the door 19 is closed and the latch member 49 positioned so that the arms 47 extend through openings 41, a portion of the latch bar member 49 will overlap the inner face 43 of the door 19 and another portion will overlap the inner surface of the wall 17 on the opposite side of plate 33. Thus, a positive stop is provided that will prevent the door 19 from being moved to the position indicated in FIG. 3 by phantom lines at 57. In the event that a very large load P is applied to the outside of the door 19 in the direction of the arrow 59 this will be transmitted by the latch bar 49 into the plate 33 which is anchored to the door jamb 7 by fasteners 35 that are perpendicular to the direction of the load P. Thus, there is little likelihood that the load will pull out the latch plate or cause the latch assembly 31 to come loose. This feature is the same whether the latch member 49 is inserted from the left (as illustrated in the drawings) or reversed so that it is inserted from the right, provided that the member 49 overlaps the door surface 43 a sufficient amount to always provide a barrier confining the door 19 between it and the vertical stop shoulder 45. Shaking of the door 19 is not likely to cause the latch member 49 to work its way out of the latch plate 33 because of the notches 53. Additional security against the effect of shanking or vibration can be achieved by simply running a wire or string through opening 58 in the latch bar 49 and in the clearance between the arm 47 and the edges of an opening 41 and tying it to the latch plate 33. Since no load is placed on the string or wire this would amount to a positive means for holding the latch assembly in a locked condition in spite of violent forces applied to the door 19 or the wall 17.

It will now be realized that the invention provides a simple latch structure that may be installed and used on most doors by persons having no training or skills and that when installed it provides a simple but highly effective means to prevent a door from being forced open against the wishes of those inside a room for which the door is the access. Modifications in the specific structural details may be made without departing from the spirit and scope of the invention.

What is claimed is:

1. A door latch assembly comprising a thin flat latch plate and a latch bar member, said flat latch plate having a plurality of perforations in it adapted to receive fasteners whereby the plate may be secured to a door jamb in the clearance space between the jamb and the edge of a hinged door, said latch plate having a lip adapted to project into a room where the plate is mounted on the door jamb of a doorway to the room, said lip having a plurality of openings vertically spaced from each other and having inside vertical edges adapted to be located adjacent the inside surface of said door when the door is closed, said latch bar having a plurality of arms projecting transversely to the length of the bar, said arms being sized to freely project through said latch openings whereby said latch bar is supported on said lip and overlaps said door to act as a stop preventing opening of the door, said latch bar arms having vertical recesses adjacent their inner ends adapted to fit over the bottom edges of said latch openings whereby a vertical component of motion is needed to unseat the latch bar from the latch plate.

2. A door latch assembly as set forth in claim 1 wherein said latch bar assembly has an opening providing means to receive a wire or the like.

3. A door latch assembly as set forth in claim 1 wherein said latch bar comprises a plate having a vertically arranged rectangular section extending from top to bottom of a bar and a plurality of arms extending transversely from said rectangular section and shaped to project through the openings in the latch plate.

4. A door latch assembly as set forth in claim 3 wherein said arms intersect said rectangular section in corners, the bottom ones of said corners being rounded and forming said vertical recesses extending into the width of the adjacent arm to provide notches that fit over the bottom edges of the latch openings.

* * * * *